United States Patent [19]

Krell

[11] Patent Number: 5,046,339

[45] Date of Patent: Sep. 10, 1991

[54] PROTECTIVE COVER FOR KEY SAFE

[76] Inventor: Darrnell D. Krell, 12087 Evergreen St., Coon Rapids, Minn. 55433

[21] Appl. No.: 35,873

[22] Filed: Apr. 8, 1987

[51] Int. Cl.[5] ..... E05B 67/38

[52] U.S. Cl. ..... 70/55; 70/63; 206/523

[58] Field of Search ..... 70/54–56, 70/63; 206/523, 524; D8/331, 334, 345, 346; D9/434, 435, 444

[56] References Cited

U.S. PATENT DOCUMENTS

| | | | |
|---|---|---|---|
| 1,662,612 | 3/1928 | Junkunc | 150/52 |
| 3,436,937 | 4/1969 | Barrett | 70/63 |
| 3,559,429 | 2/1971 | Hermann | 70/56 X |
| 3,565,243 | 2/1971 | Freeman | 206/523 |
| 3,858,419 | 1/1975 | Hampton | 70/55 |
| 3,983,725 | 10/1976 | Manuel et al. | 70/55 |
| 3,994,115 | 11/1976 | Mako et al. | 206/523 X |
| 4,134,280 | 1/1979 | Pelavin | 70/55 |
| 4,286,445 | 9/1981 | Sills | 70/55 |
| 4,297,861 | 11/1981 | Dykes | 70/55 |
| 4,317,344 | 3/1982 | Barnard | 70/55 |
| 4,516,000 | 5/1985 | Ryberg et al. | 70/408 X |
| 4,555,920 | 12/1985 | Stanich | 70/54 |
| 4,651,543 | 3/1987 | Heald et al. | 70/54 |
| 5,534,190 | 8/1985 | Stanich | 70/54 |

FOREIGN PATENT DOCUMENTS

| | | | |
|---|---|---|---|
| 154804 | 10/1938 | Austria | 70/55 |
| 542386 | 1/1932 | Fed. Rep. of Germany | 70/55 |

*Primary Examiner*—Lloyd A. Gall
*Attorney, Agent, or Firm*—Richard E. Brink

[57] ABSTRACT

A lock box, or key safe, is provided with a light weight, flexible, shock-absorbing jacket to minimize or eliminate marking, denting, or other damage caused by the box's inadvertently contacting areas adjacent to where it is mounted. The presently preferred jacket material is crosslinked closed cell polyethylene foam.

8 Claims, 1 Drawing Sheet

PROTECTIVE COVER FOR KEY SAFE

BACKGROUND OF THE INVENTION

This invention relates to covers for padlocks or the like and is particularly concerned with protective covers for lock boxes, or key safes.

There are many situations in modern living where it is desired to limit or control access to vehicles, utility rooms, security areas, etc. A particular example is found in connection with the sale of real estate where a number of agents may be showing the property to prospective buyers at different times. It is both impractical and undesirable to provide each agent with a key to the premises, and requiring an agent to obtain a key from the head sales office is often inconvenient. This problem has been solved by providing what is known as a "key safe," which is a hollow cast metal box adapted to contain a single key in the interior; see, e.g., U.S. Pat. No. 3,436,937, the disclosure of which is incorporated herein by reference. One source of key safes is Supra Products, Inc. This box has a front panel that is closed with a lock, especially a combination lock. The key safe is also provided with an external shackle that is slipped over a door knob, mounted on a vehicle door handle or other exterior hardware, or snapped into a link fence. Once installed, the key safe can be removed only with a key or combination that opens the shackle. By unlocking the front panel of the key safe, an authorized person gains access to the key contained in its interior.

Useful and convenient though key safes are, they suffer from one serious drawback. Of necessity they are made of heavy and sturdy metal, and they tend to bang against nearby surfaces, e.g., the front door or molding of a house, the door panel of an automobile, etc. In the process, paint is often chipped, arcuate scratch marks are imparted, and dents may be produced, all to the annoyance of the person whose property is being protected.

Some heavy key safes have been provided with a vulcanized rubber moulding that surrounds the base in order to prevent the problems just discussed. Although scratching and denting are reduced, the rubber tends to cause unattractive black marks. Further, the rubber moulding is expensive to produce and, since it is not absolutely essential for the key safe to function, customers resist buying it.

BRIEF DESCRIPTION

The present invention provides a simple, convenient, and inexpensive way of solving the problems discussed above. Key safes (lock boxes) are provided with a light weight, non-marking, removable moisture-resistant, flexible, resiliently stretchable, compressible polymeric jacket that functions as a shock absorber. The hollow key safe is provided with a jacket having the general form of a unitary open shallow box having a back panel, two end panels, and two side panels, the interior dimensions of the jacket corresponding to the exterior dimensions of the back, ends, and sides of the key safe. The jacket is made of material that is capable of retaining its shape prior to being applied to the key safe, preferably flexible, resiliently stretchable, compressible, shock-absorbing closed cell polymeric foam. Fitting snugly around the back, ends, and sides of the key safe, it prevents the key safe from marking, denting, or scratching the surface that it contacts in normal use.

BRIEF DESCRIPTION OF THE DRAWING

Understanding of the invention will be enhanced by referring to the accompanying drawing, in which like numbers refer to like parts in the several views, and in which.

DETAILED DESCRIPTION

Figure 2:
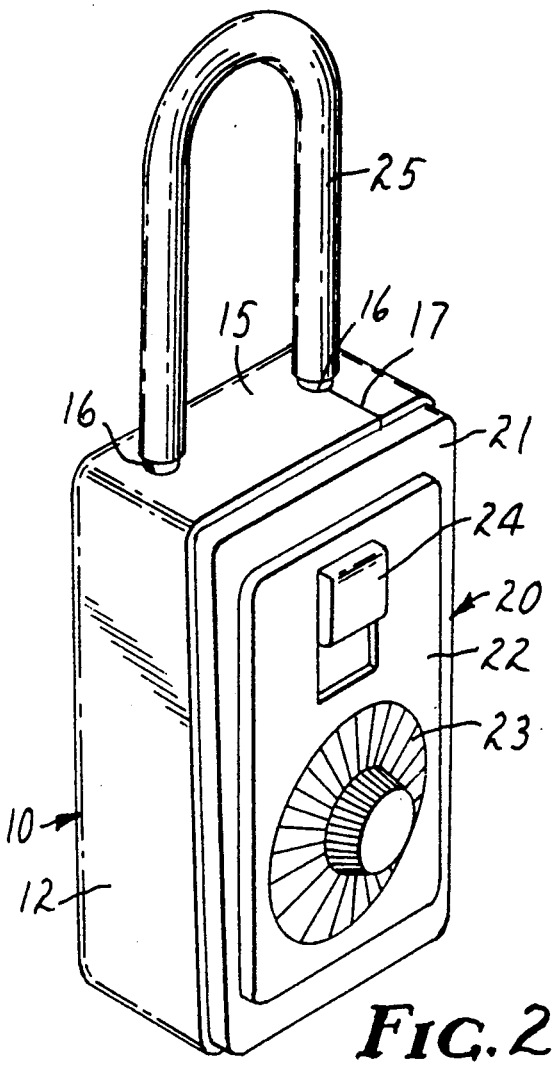
FIG. 2 is a perspective view of a key safe on which is mounted the jacket of FIG. 1.

In the drawing, protective jacket 10 has the general shape of a shallow open box, comprising back panel 11, left side panel 12, right side panel 13, bottom end panel 14, and top end panel 15. Top panel 15 is provided with holes 16, slit 17 extending from at least one hole 16 to the open edge of panel 15.

Figure 3:
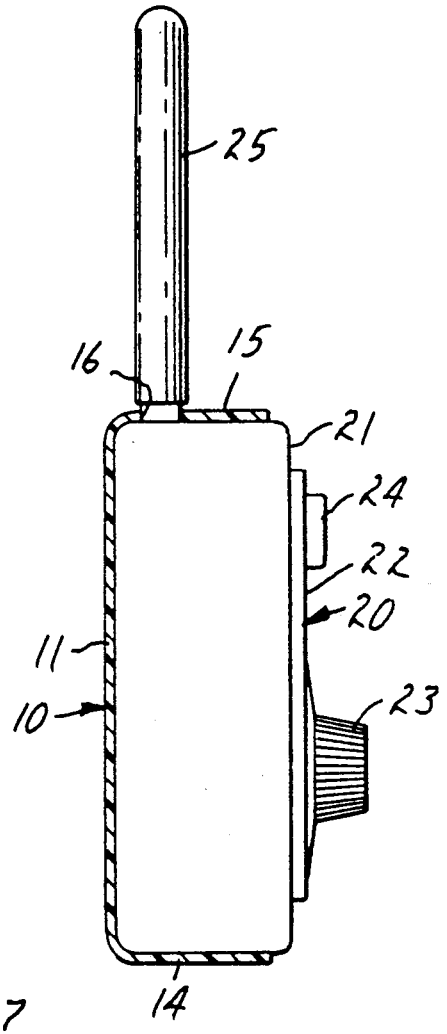
FIG. 3 is a side view of the key safe and jacket shown in FIG. 2, some parts being shown in section.
Figure 1:
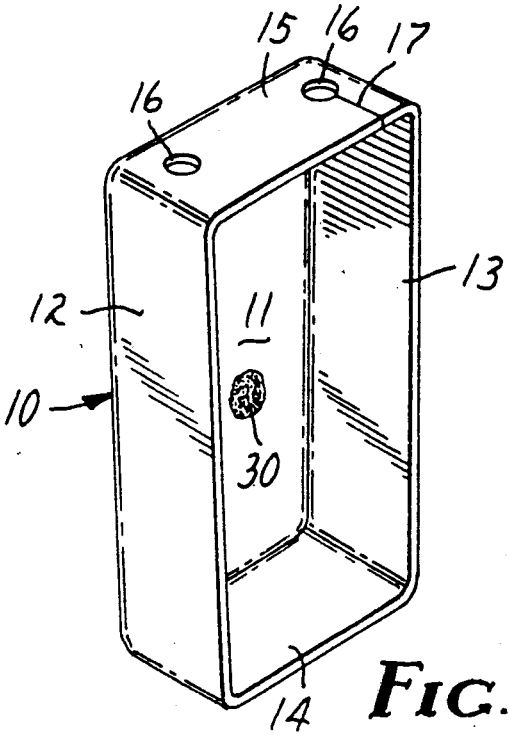
FIG. 1 is a perspective view of the jacket of the invention.

Turning to FIGS. 2 and 3, key safe 20 has rear, side, and end panels (not shown) and front panel 21, which is fitted with removable plate 22, combination dial 23 being mounted on plate 22 and providing a means of removing it. When the proper combination is entered, button 24, mounted on plate 22, can be slid downward to provide access to the interior of key safe 20.

Extending from the top of key safe 20 is inverted U-shaped shackle 25, typically covered with rubber or vinyl tubing to minimize marring of the door knob or other hardware to which shackle 25 may be attached. One leg of shackle 25 remains in the interior of key safe 20 at all times, but shackle 25 is usually spring loaded so that unlocking it causes it to pop upward, releasing one leg, and enabling it to rotate around the other leg.

When jacket 10 is mounted on key safe 20, one hole 16 may be threaded over shackle 25 and seated at the location where the permanently located leg emerges from the top of key safe 20. The other hole 16 is then positioned over the hole in the top of key safe 20 through which shackle 25 is inserted. The remainder of jacket 10 is then maneuvered around the back, sides, and bottom end of key safe 20. In this arrangement, shackle 25 ensures that jacket 10 will remain in position on key safe 20. If desired, the mounting of jacket 10 on key safe 20 can be simplified by providing slit 17 from hole 16 to the open edge of top panel 15; slit 17 permits easier mounting of jacket 10, the permanently anchored leg of shackle 25 merely being forced through slit 17 into hole 16. It is feasible, of course, to have a slit 17 extending from each hole, so that jacket 10 can be readily installed on key safe 20 even when the shackle is closed, as when the key safe is already positioned for use.

Jacket 10 is preferably formed of extremely light weight, tough, resilient closed cell polymeric foam, especially crosslinked polyethylene foam weighing 1.5–12 lbs./ft$^3$. Suitable white or pastel foams are commercially available from Dow Chemical Company under the trade designation "Ethofoam" XL and from Voltek under the trade designation "Volare" 4A. Sheets of foam initially $\frac{1}{8}$" thick and weighing 4 lbs./ft$^3$ can be thermoformed to the shape of jacket 10, the resultant wall thickness being about 0.080 inch. This particular foam is durable, inexpensive, and shock-absorbing, and has a clinging texture that helps it to adhere to the metal exterior of a key safe. If desired, however, one or more of the interior surfaces of the panels of jacket 10 may be provided with adhesive 30, e.g., a spot of pressure-sensitive adhesive, to help maintain jacket 10 in position.

It is recognized that others have previously applied covers to padlocks; see, e.g., U.S. Pat. Nos. 1,662,612, 4,134,280, 4,317,344, 4,534,190, and 4,555,920, but it is believed that no one has heretofore recognized the unusual utility of a simple jacket of the type described for a key safe.

A number of modifications of the described jacket can be made without departing from the spirit of the invention. For example, the jacket may be formed to extend around the outer portion of the key safe's front panel; indeed, it may be desirable to help maintain the jacket in place by providing it with a strap or flap that extends across the front panel.

Similarly, for aesthetic or strengthening purposes, it may be desirable to incorporate ribs, bosses, ripples, etc., into the shell of the key safe. For similar reasons, it may be desirable to incorporate dye or pigment into the foam, or to coat the exterior with a colored skin to impart an appearance other than the white presented by the foam. It may even be possible to form a jacket by injection molding a foamable polymer or a suitable vinyl polymer.

Numerous other variations will undoubtedly occur to those skilled in the art without departing from the spirit of the invention. Accordingly, the scope of the invention is defined by the appended claims.

I claim:

1. A jacket for mounting on and protectively covering the back and sides of a key safe while leaving the front of the key safe exposed, said key safe comprising a hollow metal body having a removable front panel normally closed with a lock to control access to the hollow interior of the body, said interior being adapted to receive and contain a key that opens a lock, a 2-legged U-shaped shackle extending from one end of the key safe to permit attachment to door knobs, handles, and the like, said jacket being in the form of a unitary open shallow box having a back panel, two end panels, and two side panels, the interior dimensions of said jacket corresponding to the exterior dimensions of the back, ends, and sides of the key safe on which it is to be mounted, one of the end panels being provided with two small spaced holes to accommodate the two legs of the shackle of the key safe, said jacket being capable of retaining its shape prior to being applied to the key safe and formed of light weight flexible, resiliently stretchable, compressible, shock-absorbing polymeric material, whereby a key safe fitted with said jacket is prevented from damaging surfaces with which the key safe body would otherwise contact when in use.

2. The jacket of claim 1 wherein the polymeric material is closed cell polymeric foam.

3. The jacket of claim 2 wherein the polymeric foam is crosslinked foamed polyethylene.

4. The jacket of claim 3 wherein the density of the foam is on the order of 1.5–12 lbs./ft$^3$.

5. The jacket of claim 4 wherein at least a portion of the interior of the jacket is provided with an adhesive capable of adhering directly to the back of a key safe to help maintain it in position on a key safe on which it is mounted.

6. The jacket of claim 1 wherein at least one of said holes is provided with a slit extending to the edge of the end panel to facilitate installation of the jacket on the key safe without the necessity of removing the shackle.

7. In combination, a jacket mounted on and protectively covering the back and sides of a key safe while leaving the front of the key safe exposed, said key safe comprising a hollow metal body having a removable front panel normally closed with a lock to control access to the hollow interior of the body, said interior being adapted to receive and contain a key that opens a lock, a 2-legged U-shaped shackle extending from one end of the key safe to permit attachment to door knobs, handles, and the like, said jacket being in the form of a unitary open shallow box having a back panel connecting two end panels and two side panels, the interior dimensions of said jacket corresponding to the exterior dimensions of the back, ends, and sides of the key safe on which it is mounted, one of the end panels being provided with two small spaced holes to accommodate the two legs of the shackle, said jacket being capable of retaining its shape prior to being applied to the key safe and formed of light weight flexible, resiliently stretchable, compressible, shock-absorbing polymeric material, whereby the key safe is prevented from damaging surfaces with which it would otherwise come in contact when in use.

8. A jacket for mounting on and protectively covering the back and sides of a key safe while leaving the front of the key safe exposed, said key safe comprising a hollow metal body having a removable front panel normally closed with a lock to control access to the hollow interior of the body, said interior being adapted to receive and contain a key that opens a lock, a 2-legged U-shaped shackle extending from one end of the key safe to permit attachment to door knobs, handles, and the like, said jacket being in the form of a unitary open shallow box having a back panel, two end panels, and two side panels, the interior dimensions of said jacket corresponding to the exterior dimensions of the back, ends, and sides of the key safe on which it is to be mounted, one of the end panels being provided with two small spaced holes to accommodate the two legs of the shackle of the key safe, one of said holes being provided with a slit extending to the edge of the end panel to facilitate installation of the jacket on the key safe without the necessity of removing the shackle, said jacket being capable of retaining its shape prior to being applied to the key safe and formed of light weight, flexible, resiliently stretchable, compressible, shock-absorbing polymeric material, whereby a key safe fitted with said jacket is prevented from damaging surfaces which the key safe body would otherwise contact when in use.

* * * * *